United States Patent [19]

Sloupensky et al.

[11] 4,408,447

[45] Oct. 11, 1983

[54] METHOD OF AND SYSTEM FOR CONTROLLING THE OPERATION OF OPEN-END SPINNING MACHINES

[75] Inventors: Jiri Sloupensky; Miloslav Tyl, both of Usti nad Orlici, Czechoslovakia

[73] Assignee: Vyzkumny ustav bavlnarsky, Usti nad Orlici, Czechoslovakia

[21] Appl. No.: 254,756

[22] Filed: Apr. 16, 1981

Related U.S. Application Data

[63] Continuation-in-part of Ser. No. 72,893, Sep. 6, 1979.

[30] Foreign Application Priority Data

Sep. 6, 1978 [CS] Czechoslovakia ..... 5765-78

[51] Int. Cl.[3] ..... G06F 3/04

[52] U.S. Cl. ..... 57/263; 57/264; 364/900; 364/470

[58] Field of Search ... 364/200 MS File, 900 MS File

[56] References Cited

U.S. PATENT DOCUMENTS 4,005,392 1/1977 Akatsuka et al. ..... 364/900

4,120,045 10/1978 Moellgaard et al. ..... 364/900

*Primary Examiner*—Joseph F. Ruggiero

*Assistant Examiner*—John Gladstone Mills

[57] ABSTRACT

The invention relates to a method of and a system for controlling the operation of open-end spinning machines comprising a plurality of spinning units, which method is based upon a permanent cyclic communication of a central unit of the system with the individual spinning units. According to the invention, at a given instant, a single spinning unit only is connected to the central unit of the control system, said central unit being supplied with information data about the condition of the spinning unit connected thereto while said central unit simultaneously transmits instructions for said spinning unit, the other spinning units operating automatically on the basis of the stored instruction the validity of which lasts for the time of one control cycle.

5 Claims, 4 Drawing Figures

METHOD OF AND SYSTEM FOR CONTROLLING THE OPERATION OF OPEN-END SPINNING MACHINES

This application is a continuation-in-part of application Ser. No. 72,893, filed Sept. 6, 1979.

The invention relates to a method of controlling open-end spinning machines having a plurality of spinning units, each unit comprising a silver supply device, a spinning rotor, a yarn take-off device, a spooling device, and a device for remedying thread breakage, the last-mentioned comprising rotor cleaning and yarn spinning-in means, the operation of the individual spinning units being controlled by a central control unit, as well as to a system for carrying out such method.

In existing automatically controlled multi-unit textile machines, each of their work units is usually equipped with its own electronic control means. Thus, for example, as disclosed in the Czechoslovak Inventor's Certificate No. 173,768, in open-end rotor spinning machines which operate with an automatically controlled spinning-in process on machine start and with automatic means for remedying thread breakage, each spinning unit has an almost independent electronic circuit disposed in proximity thereto. In the case of a thread breakage, these circuits assume all logic functions to control the stoppage of the spinning process as well as the connection of executive elements of the spinning unit to bus bars of a central program transmitter. A cyclic repetition of the spinning-in program permanently takes place on such bus bars. After the program has been exhausted, the system tests itself to determine whether the normal spinning process of the respective spinning unit has been restored. The automatic thread breakage remedying process can be effected only on those spinning units that are connected at this instant to the bus bar of the central program transmitter. The other spinning units, wherein a thread breakage may also have occurred, have to wait their turn till the program transmission is terminated; this practice is responsible for considerable down-times. This sytem is disadvantageous in that it requires a relatively large volume of electronic appliances appurtenant to a single spinning unit; these appliances are idle during the normal spinning process. If all the electronic circuits were to be concentrated into a central station—as actually has been done with some known systems—a particular conductor has to be led between the central station and each of the spinning units.

The above disadvantages of the prior art are eliminated, or at least mitigated in that the operation of all the spinning units, in both normal and abnormal conditions, is entirely controlled by the central control unit within successive control cycles the lasting period of which is shorter than the minimum response time of executive members of the spinning unit, by control signals generated by processing at least one information signal from the just controlled spinning unit with reference to information from a central storage unit of the central control unit about the condition of said spinning unit, said control signals controlling the operation of the executive members of the spinning unit within a time interval between two subsequent control cycles while within the period of communication between the central control unit and the respective spinning unit; the other spinning units operate automatically on the basis of the last received instruction the validity of which lasts for the time of the control cycle, irrespective of any change in the information signal within the time interval between the two subsequent control cycles.

The invention provides also an apparatus for carrying out the above method, which apparatus is characterized, according to the invention, in that the central control unit comprises a control circuitry to which control circuits of the individual spinning units are parallel-connected via an outlet bus bar, an inlet bus bar and a cycle timing conductor, each of said circuits including a D-type flip-flop series-connected to a control bus bar of the central control unit, at least one AND gate connected by its inlet to the D inlet of the D-type flip-flop, by the second inlet to a signal outlet of the spinning unit, and by its outlet to the inlet bus bar, a storage unit connected to the outlet bus bar, to the Q outlet of the D-type flip-flop, and via a decoder to executive members of the spinning unit, a timing pulse generator connected to the control circuitry and designed for generating control cycles for controlling the operation of the spinning units in periodical control intervals the lasting period of which is shorter than the minimum response time of the executive members of the spinning unit, and a central storage unit connected to the control circuitry and designed for storing data about conditions of the individual spinning units in the preceding control cycle, the control circuitry being arranged for entirely controlling the operation of all the spinning units, in both normal and abnormal conditions, by control signals generated by processing at least one of information signals from the just controlled spinning unit with reference to information from the central storage unit.

The D-type flip-flop is connected via a timing inlet T to the cycle timing conductor, via another D inlet to a Q outlet of the D-type flip-flop of the preceding spinning unit, and via the Q outlet to the D inlet of the D-type flip-flop of the next spinning unit, the D inlet of the D-type flip-flop of the first spinning unit being connected to the outlet of the central control unit.

In an alternative embodiment, a J-K-type flip-flop is connected via a timing inlet T to the cycle timing conductor, via other J-K inlets to Q and $\overline{Q}$ outlets of the flip-flop of the preceding spinning unit, via the Q and $\overline{Q}$ outlets to J-K inlets of the flip-flop of the next spinning unit, the J-K inlets of the flip-flop of the first spinning unit being connected to the outlet of the central control unit.

The Q outlet of the D-type flip-flop of the last spinning unit is connected to the central contral unit which detects, always at the end of the control cycle, the presence of the control signal at the Q outlet of the D-type flip-flop of the last spinning unit, whereby the capability of the control signal to pass over the flip-flops of all of the spinning units is checked.

An advantage of the control system of the invention is the substantial reduction of the number of conductors for connecting the central unit of the system to the individual spinning units, and, further, a more effective use of the central unit, fewer electrotechnical elements being necessary for a single spinning unit. There is also a high operational reliability of the entire system especially when employing large-scale integrated circuits, and there are relatively low costs to be expended on the equipment on the spinning unit. Any change in the function of the entire control system can be made by a mere change in its central unit, without its being necessary to change the electronic circuits installed on the individual spinning units. Continuous data about the function of the spinning units are stored in the memory of the central unit and are available for further processing such as, for example, data collection.

These and other advantages and features will be more apparent from the following description of preferred embodiments of the invention when read with reference to the accompanying drawings, in which.

An annexed Table gives an example of an instruction sequence transmitted to some of the spinning units during the spinning and thread breakage remedying processes.

The following specification describes a process of controlling open-end spinning machines, according to the present invention, as well as to a control system for carrying out the process. The specification and the accompanying drawings relate, by way of example, to a machine comprising 200 spinning units.

Figure 1:
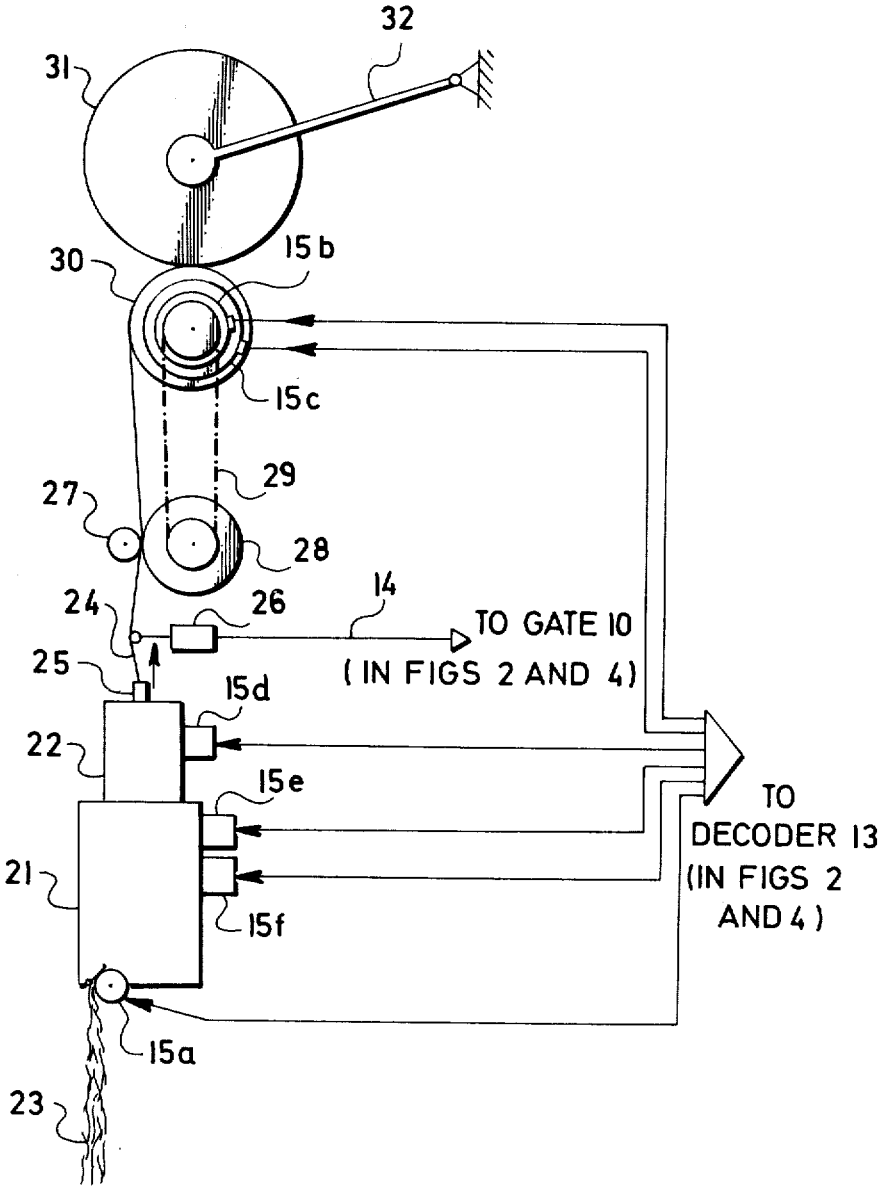
FIG. 1 shows schematically an open-end spinning unit.

FIG. 1 shows the arrangement of a spinning unit. The actual spinning unit consists of a stationary housing 21 and a tiltable housing 22. The stationary housing 21 contains a sliver feed clutch controlling electromagnet 15*a* for controlling a not-shown device for feeding a sliver 23, further a not-shown device for separating fibers from the supplied sliver 23, an electromagnet 15*e* for tilting the housing 22 which contains a spinning rotor, and finally an electromagnet 15*f* for controling a valve for pneumatically cleaning the spinning rotor.

The tiltable housing 22 contains a spinning rotor driven by a high-frequency electric motor the operation of which—viz. either running in the yarn spinning process, or braking in case of a thread breakage—is controlled by an electromagnet 15*d*.

The tiltable housing 22 carries a yarn take-off tube 25 followed by a thread breakage feeler 26 arranged to release an information signal which is transmitted to a gate 10 (see FIGS. 2 and 4) and is further processed in the control circuitry 3 of a central control unit 1 (FIGS. 2 and 4) as hereinafter referred to in the specification of the control circuits.

From the feeler 26 the yarn 24 is advanced to take-off rollers 27, 28 which are driven, e.g. through a "Timing" belt 29, from a driving drum 30. Yarn is then wound onto a bobbin 31 fixed to a swinging bobbin holder 32.

The driving drum 30 is driven from not shown means via a reverse clutch which provides a forward motion of said drum 30 when yarn is wound onto the bobbin, stops the drum in the case of a thread breakede, provides backward motion to return yarn into the spinning rotor during the spinning-in or thread breakage remedying step, and again provides a forward motion to wind the yarn after the thread breakage has been repaired. The reverse clutch, as known, e.g., from the machinery technology, consists of two electromagnetic clutch parts adapted to be alternately connected to oppositely rotating drive means. By connecting one clutch part to the take-off drive, yarn is caused to be withdrawn while by connecting the second part to the reverse motion drive, the yarn is returned; by disconnecting the two parts, the driving drum 30 comes to a standstill.

Figure 2:
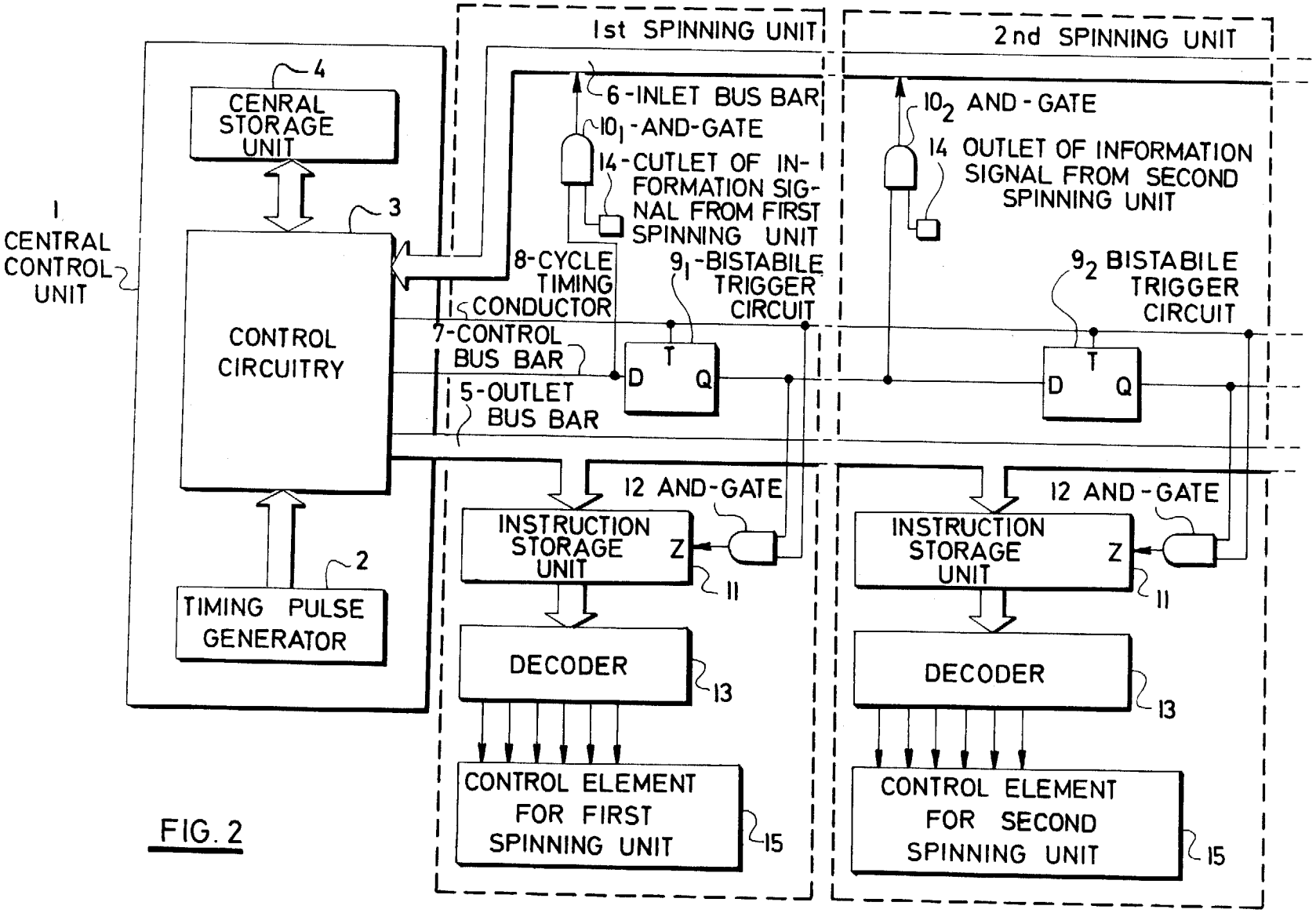
FIG. 2 is a block wiring diagram of control circuits of the spinning units and of the central control unit.
Figure 4:
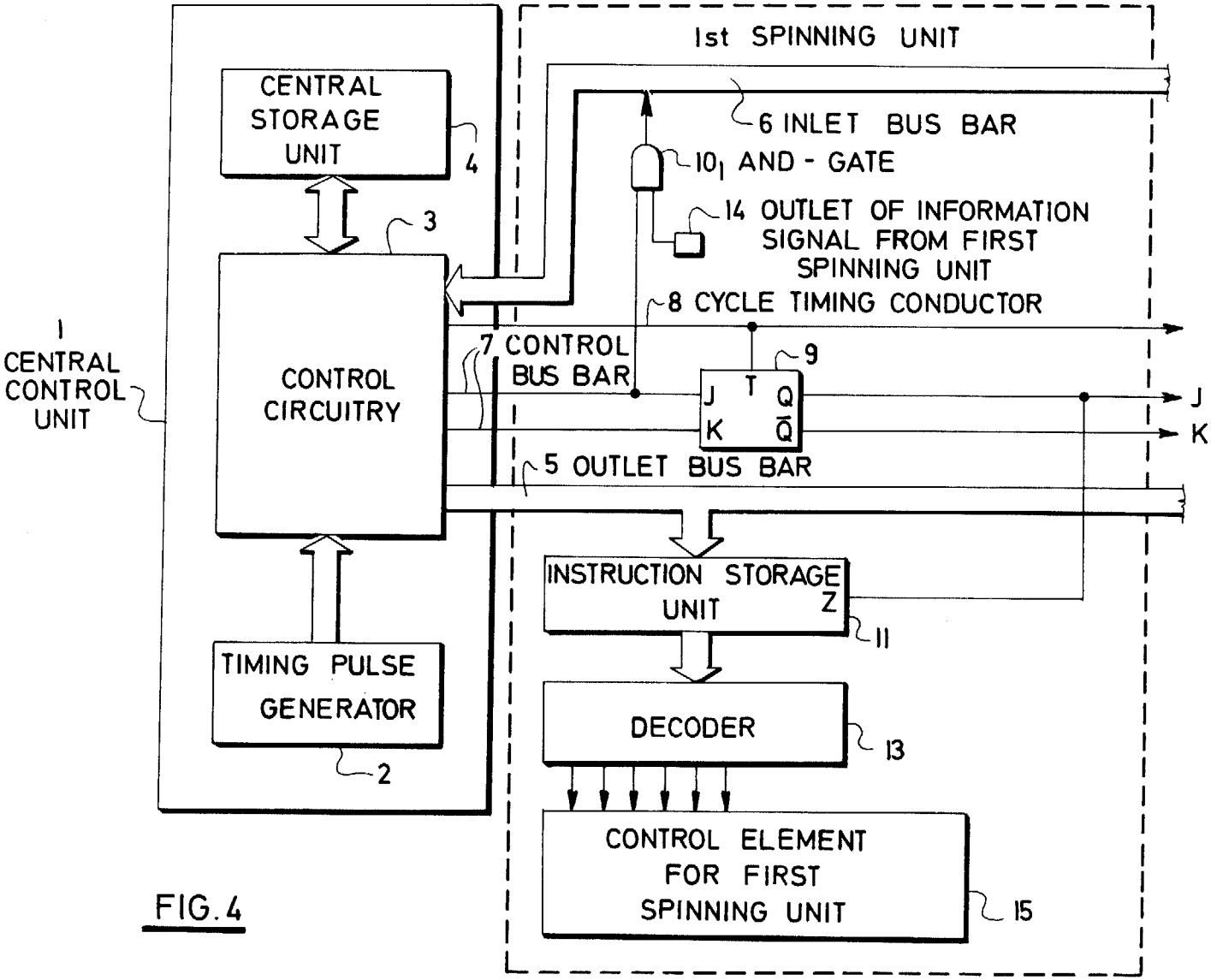
FIG. 4 is a block wiring diagram of a variant of the system depicted in FIG. 2.

In FIG. 1, the first clutch part is indicated by 15*b* and the second clutch part by 15*c*. The operation of the clutch parts is controlled by signals released from a decoder 13 (FIGS. 2 and 4). The elements 15*a*, 15*b*, 15*c*, 15*d*, 15*e* and 15*f* constitute the executive member 15 (FIGS. 2 and 4) of the spinning unit designed for remedying thread breakages and for cleaning the spinning rotor.

A first exemplary embodiment of the control system is shown in FIG. 2 in the form of a block wiring diagram in which 1 indicates a single stationary central control unit and which comprises electronic control circuits for the individual spinning units. The central control unit 1 of the control system comprises a timing pulse generator 2 which serves for periodically initiating a control cycle within uniform time intervals of, for example, 10 milliseconds. The outlet of the timing pulse generator 2 is connected to the control circuitry 3 containing all the control circuits necessary for controlling the technological process taking place in the individual spinning units. Such a single control circuitry is used for the subsequent control of all the spinning units. To the control circuitry 3 there is connected a central random-access storage unit 4 (RAM) which serves for storing data about the momentary actions or conditions of the individual spinning units. The central storage unit 4 contains a number of memory cells which corresponds to the number of the spinning units to be controlled.

To the control circuitry 3 there are connected electronic control circuits of the individual spinning units via an outlet bus bar 5, inlet bus bar 6, control bus bar 7 and a cycle timing conductor 8.

The outlet bus bar 5 comprises a number of conductors corresponding to that of controlled executive members 15 of the spinning units while the inlet bus bar 6 comprises a number of conductors corresponding to that of signals scanned from the spinning units.

When employing D-type flip-flop circuits 9, the control bus bar 7 comprises either a single conductor (see FIG. 2—the first variant with D-type flip-flops), or two conductors (see FIG. 4—the second variant with J-K-type flip flops).

Variant 1—FIG. 2

An electronic control circuit of a single spinning unit comprises a D-type flip-flop 9 for connecting the spinning unit to the central control unit 1, said flip-flop 9 being connected by its T inlet to the cycle timing conductor 8. The D inlet of the flip-flop $9_1$ of the first spinning unit is connected via control bus bar 7 to the outlet of the central control unit 1. The Q outlet of the flip-flop $9_1$ is connected to the D inlet of the next flip-flop $9_2$ of the second spinning unit. The next flip-flop (not shown) is connected by its D inlet to the Q outlet of the preceding flip-flop $9_2$, and so forth. In this way, a control signal is passed through the bus bar 7 to all the spinning units. The Q outlet of the flip-flop of the last spinning unit (not shown) either remains idle, is led back to the central control unit or is employed for controlling the passage of the control signal along the bus bar 7 to all the spinning units and, consequently, provides for checking the condition of said control bus bar 7.

To the inlet of the flip-flop $9_1$ there is further connected one of the inlets of an AND gate $10_1$ the second inlet of which is used as the outlet 14 of information signals released, e.g., by the thread breakage feeler 26. The outlet of the gate $10_1$ is connected to the inlet bus bar 6. In case there are a plurality of information signals, a corresponding number of gates 10 is employed; all the first inlets of gates 10 are connected to the D inlet of the flip-flop 9 while their second inlets are used for receiving the information signals (e.g. from the thread breakage feeler, operator's pushbutton, sliver detector, full bobbin feeler etc.). For every kind of information signals there is used a particular conductor of the inlet bus bar 6 to which the outlets of the gates 10 of all the spinning units appurtenant to the same kind of the information signal are always connected. Such possibilities are not shown in the drawings. To the Q outlet of the flip-flop $9_1$ there is connected one inlet of an AND gate 12 the second inlet of which is connected to the cycle timing conductor 8. The outlet of the AND gate 12 is connected to an instruction storage unit 11 of the electronic control circuit, the unit 11 being connected by its inlets to the bus bar 5.

The outlets of the instruction storage unit 11 are connected to a decoder 13 which cares for amplification and adjustment of the signals released from the storage unit 11 in such a manner that the signals can control the electromagnetic executive members 15 of the spinning unit.

Variant 2—FIG. 4

The same reference characters are employed to designate parts in FIG. 4 which are the same as those in FIG. 2.

The control circuit of a single (first) spinning unit comprises a J-K-type flip-flop 9. The J and K inlets of the flip-flop appurtenant to the first spinning unit are connected to the outlet of the central control unit 1 via bus bar 7 which latter consists in this case of two conductors. The Q and $\overline{Q}$ outlets of the flip-flop 9 are connected to the J and K inlets of the corresponding flip-flop of the next spinning unit (not shown). What has been said of the Q outlet in variant 1 (FIG. 2) holds true for the Q and $\overline{Q}$ outlets of the flip-flop of the last spinning unit in FIG. 4.

At least one of the AND gates 10 is connected by its inlet to the J inlet of the flip-flop 9, by its second inlet to the outlet 14 of the information signal, and by its outlet to the inlet of the bus bar 6, in a manner similar to variant 1.

In FIG. 4, the instruction storage unit 11 is connected directly to the Q outlet of the flip-flop 9; further storage unit wiring in the embodiment of FIG. 4 corresponds to that above-described with reference to variant 1 (FIG. 2).

DESCRIPTION OF THE FUNCTION OF THE CONTROL SYSTEM ACCORDING TO THE INVENTION

The control system is designed for controlling all the operational steps performed in the spinning unit as follows:

Description of the individual operational steps of the exemplary spinning unit in FIG. 1

SPINNING: the spinning unit is supplied with fibrous sliver and the normal spinning process takes place; the executive members 15*a* and 15*b* are in operation;

THREAD BREAKAGE: the yarn production is interrupted; due to an information signal, the executive members 15*a*, 15*b* and 15*d* are set out of operation;

STOP: the spinning unit comes to a standstill, which means that the yarn ceases to be wound on to the bobbin, the spinning rotor is braked, and a predetermined yarn length is returned for making its end suitable for spinning-in; the executive member 15*c* remains in operation; the down-time is about 20 seconds;

CLEANING: after a thread breakage has occurred, the spinning rotor has to be cleaned from fiber remainders and various impurities; for this purpose it is necessary to open the spinning unit to remove the impurities, e.g., by blowing out, and to reclose the spinning unit; the executive members 15*e* and 15*f* remain in operation; this step takes, e.g., 10 seconds.

During the thread breakage remedying step in one or more spinning units, the control system of FIG. 2 operates as follows:

During the normal spinning process in all the spinning units, all the units are periodically tested and attended to by the central control unit within a control cycle of 10 milliseconds so that in case of a machine comprising 200 spinning units, the attendance of a single spinning unit takes 50 microseconds. Within the interval of 50 microsends, the condition of each spinning unit is tested and the respective information is transmitted by an information signal from the thread breakage feeler 26 of each unit via gate $10_1$ and the inlet bus bar 6. Depending upon the test results and on information from the storage unit 4, wherein the information about the condition of the spinning unit from the preceding 10 milliseconds cycle has been stored, the central control unit 1 will generate an instruction signal determining the spinning unit operation within the next 10 milliseconds interval. As hereinabove set forth, the cycle is repeated within this time interval. Thus, in the event the spinning unit is in normal operation, the instruction signal for spinning is released once more. In case of a thread breakage at a particular spinning unit, however, the stop instruction is transmitted by the central unit 1 and the respective particular spinning unit commences to be subjected to steps to stop it.

After this command, the control signal from the central control unit 1 will be shifted on the bus bar 7 from the D inlet of the flip-flop $9_1$ to the Q outlet thereof and, consequently, also to the D inlet of the next flip-flop $9_2$. Thus, the next spinning unit will be tested. In this way, all the spinning units are successively tested and attended to so that within 10 milliseconds a new control signal transmitted along the bus bar 7 will again reach the D inlet of the flip-flop $9_1$ of the first spinning unit which is then in the stop phase. Since this phase takes about 20 seconds, the stop instruction will be repeated and the control signal on the bus bar 7 arrives at the next spinning unit. Thus within 20 seconds of the spinning rotor stopping interval of the particular unit, 2000 cycles of 10 milliseconds each will pass through. Beginning with the 2001st cycle, the cleaning step of the particular unit is initiated by transmitting the respective instruction from the control circuitry 3. During the cleaning step which takes, say, 10 seconds, the milliseconds control cycles go on, which means that within this interval, about another 1000 cycles pass through. By this time the cleaning step of the particular unit has terminated. Within an interval of 15 seconds (i.e. 1500 cycles) the spinning rotor of the particular unit is started, and within 2 seconds (i.e. 200 cycles) a spinning attempt by such particular unit is carried out. The time periods for stopping, cleaning etc. can be predetermined by the operator on the control panel which forms a part of the control circuitry 3 and is not shown in the drawings. Such periods are set to correspond to the material being processed, to the spinning rotor speed, to the count of the yarn type being produced, and so forth.

These and similar instructions can be transmitted to another spinning unit affected by a thread breakage. In the control cycle at the end of the spinning-in step, the spinning unit is tested for spinning process restoration. In the affirmative, an instruction for spinning will then be transmitted at 10 milliseconds intervals until the next thread breakage occurs. In case of an unsuccessful spinning-in attempt, the entire process will be repeated, and after several unsuccessful attempts, the automatic spinning-in step is given up and left to the manual operator's intervention.

The instruction sequence in the thread breakage remedying step is generated separated by the central control unit 1 for each spinning unit, beginning with the thread breakage detection and ending with repair and spinning restoration. Thus the individual spinning units are operable in an overlapped manner without any unnecessary down-times. Since all the feedbacks between the thread breakage feeler 26 and the executive members 15 take place through the central control unit 1 within the time in which said unit 1 communicates with the particular spinning unit, the control cycle time (10 milliseconds) must be substantially shorter than the response times of the executive members 15 of the spinning unit. The response times of the clutches and electromagnetic values vary between 100 and 200 milliseconds. In this case a delay between the information signal and the testing thereof via gate $10_1$ becomes negligible. With the foregoing in view, the duration of the control cycle is chosen so as to be equal to about 10 percent of the minimum response time of the executive members, viz., for instance, 10 milliseconds (=10% of 100 milliseconds). With such a control cycle time interval the entire control system operates as if each of the spinning units were equipped with its own control circuitry 3 of which, however, only one is present in the machine.

The control elements not shown in detail for timing the individual steps to be made in the spinning unit, form a part of the control circuitry 3 and can be re-set by the operator. The control circuitry 3 also causes all the spinning units to be spun-in or primed when starting the machine, in such a way that after the machine starts, the same signal sequence is transmitted as if an individual thread breakage were remedied. This means that the spinning units are set in operation one after the other within an interval of 50 microseconds.

In case of thread breakage in another spinning unit has been detected before a thread breakage in a spinning unit is remedied, the last mentioned unit has to be immediately supplied with an instruction sequence generated for the spinning process restoration. In accordance with an example in the annexed TABLE 1, the thread breakage remedying step takes 4701 cycles, of 10 milliseconds each.

The function of the electronic control circuits appurtenant to a single spinning unit during one of the control cycles will hereinafter be described more in detail. The specification relates to variant 1 (FIG. 2) only; variant 2 (FIG. 4) will be referred to only as far as it distinguishes from variant 1.

The control cycle is initiated by a signal from the timing pulse generator 2 (FIG. 2). At the beginning of the cycle, the central control unit 1 releases a control signal) (FIG. 3) to the bus bar 7. The signal passes to the D inlet of the flip-flop $9_1$ of the first spinning unit and further on to the first inlet of the AND gate $10_1$. In this way the information signal is allowed to pass from its outlet 14 through the AND gate $10_1$ to the inlet bus bar 6 and further onto the central control unit. Depending upon the stored program, upon the test of the information signal and upon the information about the condition and function of the spinning unit from the past control cycles are stored in the unit 4. The central control unit 1 generates an instruction signal and lets it pass along the outlet bus bar 5. Such an instruction signal is effective only for a 50 microseconds interval and is determined for a particular spinning unit. Further, the central control unit 1 releases a pulse 31 (FIG. 3) into the cycle timing conductor 8. The rise time 32 of said pulse causes a control signal 33 to be shifted from the D inlet of the flip-flop $9_1$ to the Q outlet thereof. Thereby the control signal 33 having a rise time 35 appears in the first inlet of the AND gate 12. Since the pulse 31 on the cycle timing conductor 8 holds, said gate 12 generates a pulse at its outlet which is led to the instruction storage unit 11. As the pulse goes on, the information from the outlet bus bar 5 is being stored in the unit 11. Thus the instruction has been stored in the storage unit 11 of the first spinning unit and, at the same time, the control signal 33 has been shifted to the D inlet of the flip-flop $9_2$ of the second spinning unit. Thus the control signal 33 clears again the way through the gate $10_1$ for the information signal from its outlet 14 on the second spinning unit. In this manner, the central control unit 1—via inlet bus bar 6—tests the condition of the second spinning unit, terminates the signal on the timing conductor 8 by transferring it to the low level 36, and proceeds the spinning unit attendance similarly as with the first spinning unit. After the attendance of the second spining unit has been terminated, the control signal 34 is shifted to the Q outlet of the flip-flop $9_2$ and thereby to the inlet of the flip-flop $9_3$.

In this way the central control unit 1 is capable to attend successively within 10 millisecond intervals to all of the spinning units in the machine, whereupon it releases another signal from the timing pulse generator 2, each 10 millisecond control cycle being initiated by said signal.

Figure 3:
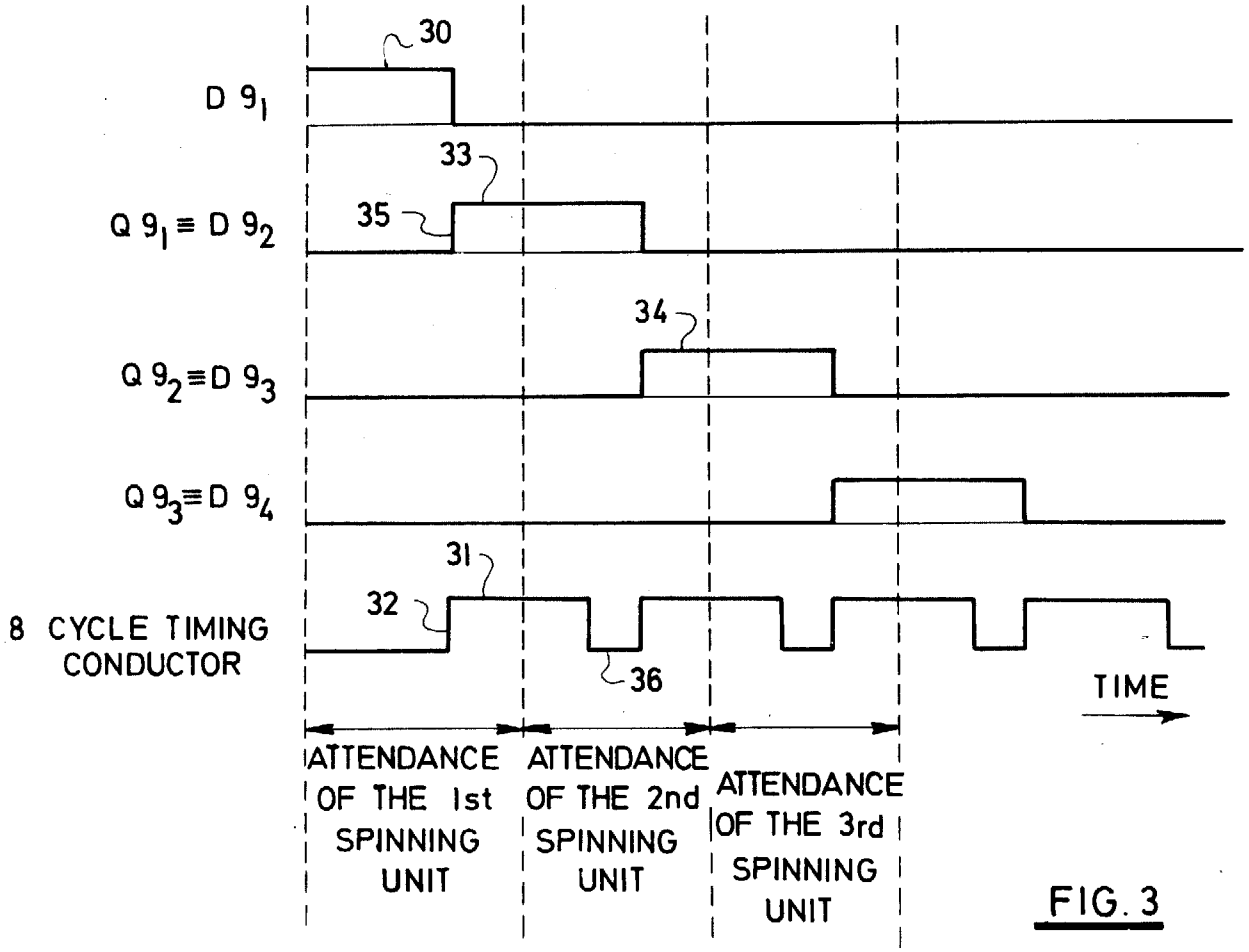
FIG. 3 shows schematically signal behaviors in the individual wiring nodes.

In FIG. 3, 34 indicates a control signal at the outlet Q which signal enables the storing into the storage unit 11 of the second spinning unit and simultaneously enables the outlet 14 of the information signal of the third (not shown) spinning unit to be tested. The signal 34 is analogous to the signal 33 but for the next spinning unit; 36 indicates a dwell, or low level, between the two shift pulses 31.

Difference between variants 2 and 1 (FIGS. 2 and 4)

When using J-K-type flip-flops 9 (FIG. 4) the control bus bar 7 consists of two conductors. The control signal—the same as in variant 1—is released along the conductor leading to the J inlets of the flip-flops $9_1$ through $9_n$. The K inlets are supplied with a negation of the control signal released to the J inlet. Since variant 2 employs such an instruction storage unit 11 that the storage takes place only within the rise time of the signal at the storing inlet z of said unit 11, the storage need not be blocked by the gate 12, and it is possible to use as storing signal 33 directly the Q outlet of the flip-flop $9_1$ through $9_n$. The rise time 35 of the signal at the Q outlet of the flip-flops $9_1$ through $9_n$, namely, appears simultaneously with the rise time 32 of the signal on the cycle timing conductor 8, which means at the instant when the instruction on the bus bar 5 is already stable and no risk of a false storage in a unit 11 occurs.

The use of the storage unit 11 of such a type that enables the storage within the rise time of the respective signal only, is not limited to the use of J-K-type flip-flops $9_1$ through $9_n$ but is possible also with D-type flip-flops $9_1$ through $9_n$, and vice versa. By completely combining the two types of flip-flops $9_1$–$9_n$ and the two types of storage unit 11, it is possible to obtain four variants of the electronic control circuits according to the invention.

indicates the inactive condition while symbol 1 indicates the active condition thereof.

Column 5 contains a brief description of the individual operational steps performed by the spinning unit in the particular time interval.

Although the invention is illustrated and described with reference to a plurality of preferred embodiments thereof, it is to be expressly understood that it is in no way limited to the disclosure of such a plurality of preferred embodiments, but is capable of numerous modifications within the scope of the appended claims.

TABLE

| 1 | 2 | 3 | 4 | | | | | | 5 |
|---|---|---|---|---|---|---|---|---|---|
| CONTROL | TIME ELAPSED FROM THREAD | THREAD BREAKAGE | EXECUTIVE MEMBERS 15 | | | | | | OPERATIONAL |
| CYCLE | BREAKAGE | FEELER | a | b | c | d | e | f | STEP |
| i − 2 | −20 msec. | 0 | 1 | 1 | 0 | 1 | 0 | 0 | SPINNING |
| i − 1 | −10 msec. | 0 | 1 | 1 | 0 | 1 | 0 | 0 | |
| i | 0 | 1 | 0 | 0 | 1 | 0 | 0 | 0 | THREAD BREAKAGE |
| i + 1 | 10 msec. | 1 | 0 | 0 | 1 | 0 | 0 | 0 | THREAD END RETURN |
| . | . | . | . | . | . | . | . | . | |
| i + 100 | 1.0 sec. | 1 | 0 | 0 | 1 | 0 | 0 | 0 | |
| i + 101 | 1.01 sec. | 1 | 0 | 0 | 0 | 0 | 0 | 0 | SPINNING ROTOR |
| . | . | . | . | . | . | . | . | . | |
| i + 2000 | 20.00 sec. | 1 | 0 | 0 | 0 | 0 | 0 | 0 | STOPPING |
| i + 2001 | 20.01 sec. | 1 | 0 | 0 | 0 | 0 | 1 | 0 | SPINNING ROTOR |
| . | . | . | . | . | . | . | . | . | |
| i + 2300 | 23.00 sec. | 1 | 0 | 0 | 0 | 0 | 1 | 0 | OPENING |
| i + 2301 | 23.01 sec. | 1 | 0 | 0 | 0 | 0 | 1 | 1 | SPINNING ROTOR |
| . | . | . | . | . | . | . | . | . | |
| i + 3000 | 30.00 sec. | 1 | 0 | 0 | 0 | 0 | 1 | 1 | CLEANING |
| i + 3001 | 30.01 sec. | 1 | 0 | 0 | 0 | 1 | 0 | 0 | SPINNING ROTOR |
| . | . | . | . | . | . | . | . | . | |
| i + 4500 | 45.00 sec. | 1 | 0 | 0 | 0 | 1 | 0 | 0 | START SPINNING-IN PROCESS |
| i + 4501 | 45.01 sec. | 1 | 1 | 0 | 0 | 1 | 0 | 0 | MATERIAL SUPPLY YARN |
| . | . | . | . | . | . | . | . | . | |
| i + 4550 | 45.50 sec. | 1 | 1 | 0 | 1 | 1 | 0 | 0 | END RETURN YARN TAKE-OFF |
| . | . | . | . | . | . | . | . | . | |
| i + 4600 | 46.00 sec. | 0 | 1 | 1 | 0 | 1 | 0 | 0 | |
| . | . | . | . | . | . | . | . | . | |
| i + 4700 | 47.00 sec. | 0 | 1 | 1 | 0 | 1 | 0 | 0 | |
| i + 4701 | 47.01 sec. | 0 | 1 | 1 | 0 | 1 | 0 | 0 | SPINNING-IN TEST |
| i + 4702 | 47.02 sec. | 0 | 1 | 1 | 0 | 1 | 0 | 0 | SPINNING |
| . | . | . | . | . | . | . | . | . | |
| . | . | . | . | . | . | . | . | . | |
| . | . | . | . | . | . | . | . | . | |

Legend to the Above Table

The Table gives an example of the instruction sequence transmitted to a spinning unit during the spinning and thread breakage remedying processes.

The timings of the individual operational steps are informative only since they depend, in practice, on technological conditions to which the open end spinning machine is subjected to. The particular time data are set by the machine operator.

Column 1 contains a sequence of control cycles; in the cycle i a thread breakage was detected.

Column 2 comprises the timings of all the operational steps since the instant of thread breakage.

Column 3 sets forth an information signal released from the thread breakage feeler. Symbol 0 indicates the operative condition of the spinning unit while symbol 1 stand for thread breakage.

Column 4 informs about the instructions transmitted to the spinning unit during the individual operational steps and refers to the conditions of the individual executive members 15*a* through 15*f* (see FIG. 1). Symbol 0 in column 4 under the particular executive member 15

What is claimed is:

1. In a method of controlling open-end spinning machines having a plurality of spinning units, each comprising a sliver supply device, a spinning rotor, a yarn take-off device, a spooling device and a device for remedying thread breakages, the last-mentioned comprising rotor cleaning and yarn spinning-in means, the operation of the individual spinning units being controlled by a central control unit, the improvement wherein the operation of all the spinning units, in both a normal spinning process and a process of remedying thread breakages, is entirely controlled by the central control unit within successive control cycles the time of duration of which is shorter than the minimum response time of executive members of the spinning unit, by control signals generated on the basis of evaluation of at least one of the information signals from the just controlled spinning unit and on the basis of sequence of programmed thread breakage remedying steps from a central storage unit of the central control unit, said control signals controlling the operation of the executive members of the spinning unit within a time interval between two subsequent control cycles while within the period of communication between the central control unit and the respective spinning unit, the other spinning units performing the operation determined by the last received instruction the validity of which lasts for the time of the control cycle, irrespective of any change in the information signal within the time interval between the two subsequent control cycles.

2. In an apparatus for controlling open-end spinning machines having a plurality of spinning units, each comprising a sliver supply device, a spinning rotor, a yarn take-off device, a spooling device and a device for remedying thread breakages, the last-mentioned device comprising rotor cleaning and yarn spinning-in means based upon the principle of yarn end return into the spinning rotor, the spinning machine being associated with a central control unit for controlling the operation of the individual spinning units, the improvement wherein the central control unit comprises a control circuitry to which control circuits of the individual spinning units are parallel-connected via an outlet bus bar, an inlet bus bar and a cycle timing conductor, each of said circuits including a D-type flip-flop series-connected to a control bus bar of the central control unit, at least one AND gate connected by its one inlet to the D inlet of the D-type flip-flop, by the second inlet to a signal outlet of the spinning unit, and by its outlet to the inlet bus bar, a storage unit connected to the outlet bus bar, to the Q outlet of the D-type flip-flop, and via a decoder to executive members of the spinning unit, a timing pulse generator connected to the control circuitry and designed for generating control cycles for controlling the operation of the spinning units in periodical control intervals the lasting period of which is shorter than the minimum response time of the executive members of the spinning unit, and a central storage unit connected to the control circuitry and designed for storing data about conditions of the individual spinning units in the preceding control cycle, the control circuitry being arranged for entirely controlling the operation of all the spinning units, in both normal and abnormal conditions, by control signals generated by processing at least one of the information signals from the just controlled spinning unit with reference to information from the central storage unit.

3. An apparatus as claimed in claim 2, wherein the D-type flip-flop is connected via a timing inlet T to the cycle timing conductor, via another D inlet to a Q outlet of the D-type flip-flop of the preceding spinning unit, and via the Q outlet to the D inlet of the D-type flip-flop of the next spinning unit, the D inlet of the D-type flip-flop of the first spinning unit being connected to the outlet of the central control unit.

4. An apparatus as claimed in claim 2, wherein a J-K-type flip-flop is connected via a timing inlet T to the cycle timing conductor, via other J-K inlets to Q and $\overline{Q}$ outlets of the flip-flop of the preceding spinning unit, via the Q and $\overline{Q}$ outlets to J-K inlets of the flip-flop of the next spinning unit, the J-K inlets of the flip-flop of the first spinning unit being connected to the outlet of the central control unit.

5. An apparatus as claimed in claim 2, wherein the Q outlet of the D-type flip-flop of the last spinning unit is connected to the central control unit which detects, always at the end of the control cycle, the presence of the control signal at the Q outlet of the D-type flip-flop of the last spinning unit, whereby the capability of the control signal to pass over the flip-flops of all the spinning units is checked.

* * * * *